US007201678B2

(12) United States Patent
Filice et al.

(10) Patent No.: US 7,201,678 B2
(45) Date of Patent: Apr. 10, 2007

(54) SPORTS EQUIPMENT HANDLE WITH CUSHION AND GRIP RIBS

(75) Inventors: Gary Filice, Moorpark, CA (US); Dean E. Meyer, Oakbrook, IL (US); Larry Carlson, Santa Clarita, CA (US); Scot Brown Herbst, Douglas, MI (US)

(73) Assignee: Easton Sports, Inc., Van Nuys, CA (US)

( * ) Notice: Subject to any disclaimer, the term of this patent is extended or adjusted under 35 U.S.C. 154(b) by 55 days.

(21) Appl. No.: 10/666,449

(22) Filed: Sep. 19, 2003

(65) Prior Publication Data

US 2005/0064964 A1 Mar. 24, 2005

(51) Int. Cl.
*A63B 59/02* (2006.01)
*A63B 65/12* (2006.01)

(52) U.S. Cl. ..... 473/513; D21/724

(58) Field of Classification Search ..... 473/512, 473/513, 505; D21/724
See application file for complete search history.

(56) References Cited

U.S. PATENT DOCUMENTS

| | | | | |
|---|---|---|---|---|
| 748,000 | A | 12/1903 | Murname | |
| 841,336 | A * | 1/1907 | North | 403/293 |
| 1,165,484 | A | 12/1915 | Zimmerman | |
| 1,638,454 | A | 8/1927 | Papin | |
| 1,687,736 | A | 10/1928 | Root | |
| 1,963,057 | A * | 6/1934 | Wilcox | 29/897.33 |
| 2,091,458 | A | 8/1937 | Sleight | |
| 2,099,521 | A | 11/1937 | Herkimer et al. | |
| 2,115,119 | A | 4/1938 | Park | |
| 2,659,605 | A | 11/1953 | Tourneau | |
| 2,710,753 | A | 6/1955 | Lockwood | |
| 2,984,486 | A | 5/1961 | Jones | |
| 3,473,806 | A | 10/1969 | Patterson | |
| 3,606,326 | A | 9/1971 | Sparks et al. | |
| 3,702,702 | A | 11/1972 | Hoult | |
| 3,910,578 | A * | 10/1975 | Brine, Jr. | 473/513 |
| 3,940,134 | A | 2/1976 | Bieganowski | |
| 3,972,529 | A * | 8/1976 | McNeil | 473/320 |
| 4,037,841 | A | 7/1977 | Lewis, Jr. | |
| 4,206,918 | A | 6/1980 | Lewis, Jr. | |
| 4,351,528 | A | 9/1982 | Duplin | |
| RE31,419 | E | 10/1983 | Frolow | |
| 4,739,994 | A | 4/1988 | Lewis, Jr. | |
| 5,048,843 | A | 9/1991 | Dorfi et al. | |

(Continued)

OTHER PUBLICATIONS

Technical Data Sheet, PlastiDip, Jan. 22, 2002, www.plastidip.com, 5 pages.*

*Primary Examiner*—Eugene Kim
*Assistant Examiner*—M. Chambers
(74) *Attorney, Agent, or Firm*—Olson & Hierl, Ltd.

(57) ABSTRACT

A handle for sports equipment such as a lacrosse or hockey stick including cushioning and grip ribs. In one embodiment, the shaft of the handle defines one or more regions of reduced diameter or thickness such as, in one embodiment, a plurality of elongate longitudinal grooves extending around the periphery thereof in spaced-apart relationship. Interior cushioning ribs are defined in the region of the grooves by a layer of cover or coating material which is applied to the surface of the shaft and fills the grooves. In another embodiment, the shaft includes tapered regions in the shaft and the layer of cover or coating material fills the tapered regions to define cushioning ribs.

8 Claims, 5 Drawing Sheets

U.S. PATENT DOCUMENTS

| | | | |
|---|---|---|---|
| 5,482,270 | A | 1/1996 | Smith |
| 5,577,722 | A | 11/1996 | Glassberg |
| 5,730,662 | A | 3/1998 | Rens |
| D444,834 | S | 7/2001 | Tucker |
| D445,472 | S | 7/2001 | Tucker |
| 6,500,079 | B1 | 12/2002 | Tucker |
| 6,752,730 | B1 | 6/2004 | Brine |
| 2002/0094891 | A1 | 7/2002 | Horwood et al. |
| 2003/0008734 | A1 | 1/2003 | Tiitola |
| 2003/0045380 | A1 | 3/2003 | Tucker |
| 2004/0116217 | A1 | 6/2004 | Morrow |

* cited by examiner

SPORTS EQUIPMENT HANDLE WITH CUSHION AND GRIP RIBS

FIELD OF THE INVENTION

This invention relates to sports equipment handles in general and, more particularly, to cushion and grip ribs for the handles of lacrosse and hockey sticks.

BACKGROUND OF THE INVENTION

Handles for sports equipment such as, for example, hockey sticks and lacrosse sticks are often polygonal in shape and thus incorporate elongate edges or corners thereon defining ribs on the handle which provide a player with an improved grip and control of the handle. A disadvantage associated with these handles, however, is the increased risk of bodily injury and, particularly, the risk of lacerations which can, and do in fact occur, when the sticks are swung about in the normal course of play and the edges strike, for example, the face of another player. Another disadvantage is the risk of damage to the handles from stick to stick contact during play.

This invention is directed to a handle for sports equipment and, more particularly, to a handle for a hockey stick or lacrosse stick incorporating variously configured ribs, including interiorly protruding ribs, adapted to cover and cushion the edges thereof and further improve a player's grip of the handle.

SUMMARY OF THE INVENTION

The invention relates generally to a sports equipment handle and, more particularly, to a handle for a lacrosse stick comprising an elongate shaft made of a first material and including at least one region of reduced diameter or thickness and a cover made of a second material and surrounding the shaft in a manner whereby the outer diameter of the handle including the cover is substantially uniform and the cover includes at least one region of increased thickness in the region of the shaft having the reduced diameter or thickness.

In one embodiment, the shaft includes a tapered end portion defining the region on the shaft of reduced diameter or thickness and is adapted to extend into the head of a lacrosse stick so as to define a region on the handle having improved whip and flex characteristics while simultaneously preserving the outer uniform polygonal geometry of the handle.

In another embodiment, the regions of reduced diameter or thickness define respective elongate longitudinal grooves formed in the shaft and a co-extrusion process is used to fill the respective grooves with the second material to define interior ribs which do not affect the outer polygonal geometry or diameter of the handle. In another embodiment, elongate ribs protrude unitarily outwardly from the interior surface of a separate one-piece cover and the cover is fitted and secured to the shaft in a relationship where the ribs fill the respective grooves.

In still another embodiment, the shaft includes exterior and interior surfaces and the edges define elongate longitudinal slits through which ribs extend.

In a further embodiment, the edges protrude outwardly from the exterior surface of the shaft and the ribs include respective interior surfaces configured to abut against the respective edges and an adhesive secures the ribs to the respective edges.

In still a further embodiment, the shaft and ribs include interior and exterior surfaces respectively and the ribs protrude unitarily outwardly from the exterior surface of one-piece elongate cover which is shrink-wrapped to the shaft. In this embodiment, the ribs are spaced from edges of the shaft and define air-filled cushion chambers in the region of the respective shaft edges.

BRIEF DESCRIPTION OF THE DRAWINGS

In the accompanying drawings forming part of the specification in which like numerals are employed to designate like parts throughout the same.

DETAILED DESCRIPTION OF THE PREFERRED EMBODIMENTS

Figure 1:
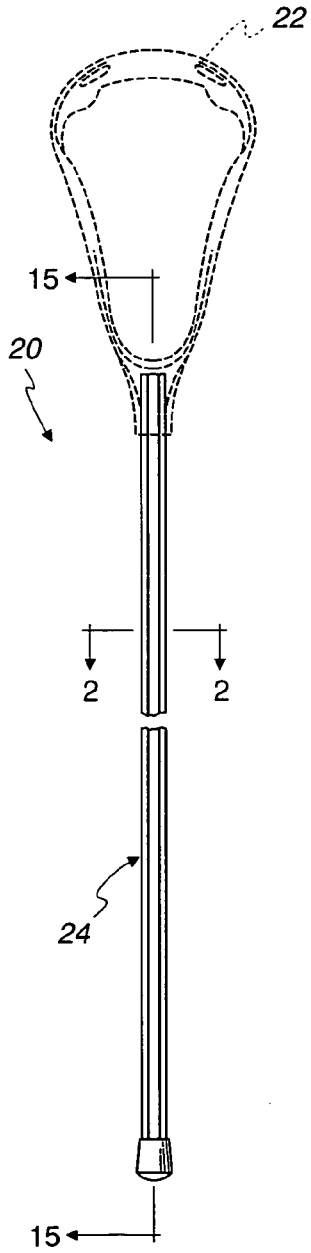
FIG. 1 is a front elevational view of a lacrosse stick incorporating a handle constructed in accordance with the present invention.

The invention disclosed herein is, of course, susceptible of embodiment in many different forms. Shown in the drawings and described herein below in detail are preferred embodiments of the handle of the present invention. It is to be understood, however, that the present disclosure is an exemplification of the principles of the invention and does not limit the invention to the illustrated embodiments.

It is also understood that the FIGURES herein do not necessarily show details of the handle that are known in the art and that will be recognized by those skilled in the art as such. The detailed descriptions of such elements are not necessary to an understanding of the invention. Accordingly, such elements are herein represented only to the degree necessary to aid in an understanding of the features of the present invention.

FIG. 1 depicts a lacrosse stick 20 including a head 22 and an elongate handle 24 constructed in accordance with the principles of the present invention.

Figure 2:
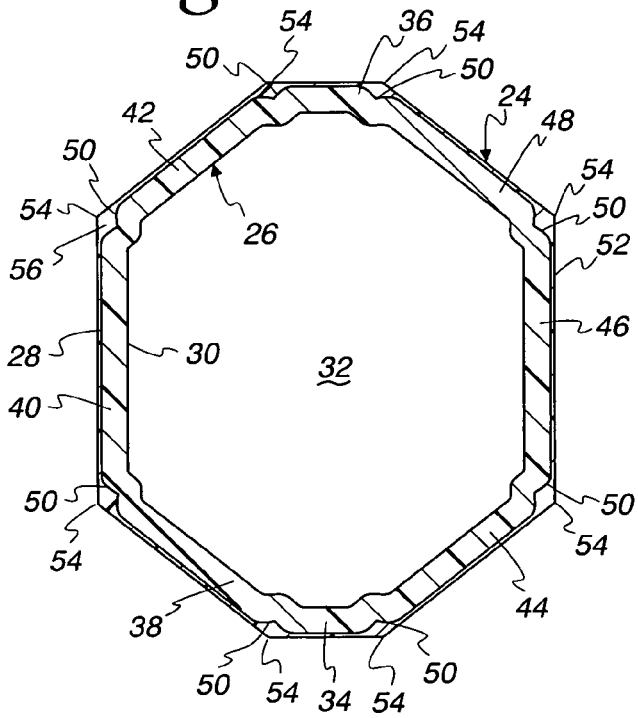
FIG. 2 is an enlarged, vertical cross-sectional view, taken along the plane 2—2 in FIG. 1, of the handle of the present invention.
Figure 3:
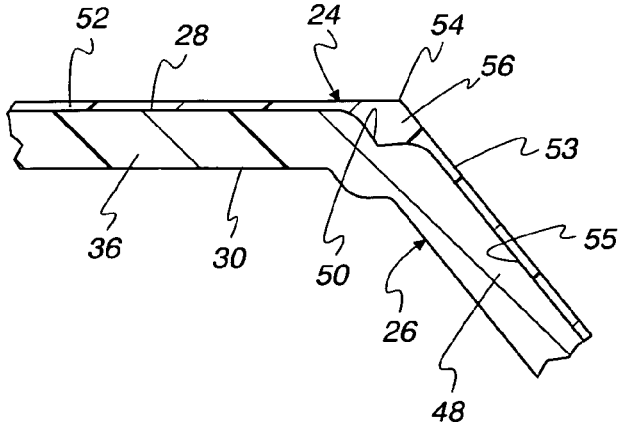
FIG. 3 is an enlarged, broken, vertical cross-sectional view of one of the corners of the handle of FIG. 2.

As shown in FIGS. 1–3, handle 24 includes an elongate generally cylindrical polygonally shaped shaft 26 made of any suitable durable first material such as, for example, wood, metal or a composite. Shaft 26 includes an exterior peripheral surface 28 and an interior surface 30 defining a hollow interior 32. In the embodiment of FIGS. 1–3, shaft 26 is octagonal in shape. Shaft 26 is characterized in that it includes two diametrically opposed and parallel exterior faces or panels 34 and 36 which are of equal width and six additional exterior faces or panels 38, 40, 42, 44, 46 and 48 which are all of an equal width greater than the width of each of the faces 34 and 36. Faces 38, 40 and 42 extend circumferentially about the exterior shaft surface 28 between faces 34 and 36 on one half of the shaft 26 while faces 44, 46, and 48 are diametrically opposed to faces 38, 40 and 42 and extend circumferentially about the exterior shaft surface 28 between faces 34 and 36 on the opposite half of the shaft 26.

Shaft 26 is further characterized in that the exterior surface 28, in the regions between each of the exterior faces thereof, defines a plurality of elongate and longitudinally extending arcuate and concavely shaped grooves, depressions, dimples or recessed edges 50. Edges 50 extend around the exterior shaft surface 28 in spaced-apart and parallel relationship.

Handle 24 further comprises a unitary coat or cover 52 which surrounds and overlies the exterior shaft surface 28 and, more particularly, each of the respective polygonal faces thereof. Cover 52 preferably comprises a soft, pliable, resilient, deformable, impact-absorbing and tacky thermoplastic material including any suitable elastomers and rubbers such as, for example, Santoprene™. Cover 52 includes a generally flat outer surface 53 defining a plurality of longitudinally extending edges or corners 54 which overly the recessed edges 50 defined in the exterior shaft surface 28.

Although the cover 52 may be either a pre-formed, pre-molded member or an overlay applied directly to the outer surface 28 of the shaft 26 using any one of several known processes including casting, interference fitting, spraying, injection molding, rotational molding, insert molding or over molding, one embodiment of the present invention encompasses the use of a Sticktrusion™ process in which the material comprising the cover 52 is co-extruded onto the exterior shaft surface 28. The process initially entails connecting a plurality of the shafts 26 along the proximal and distal ends thereof with plugs to create an extended and continuous length of shaft material. Thereafter, a feeder pushes the shafts through a stationary heater station which activates the surface energy of the shafts. The shafts are then passed or fed directly through and into the interior of a stationary crosshead extrusion die corresponding in shape to the octogonal shape of the cover 52 and including circumferentially positioned ports adapted to deposit thin layers of the material comprising the cover 52 directly onto the faces of the exterior shaft surface and into the recesses 50 defined in the exterior shaft surface 28. The shafts are then passed through the interior of a stationary cooling station where the material comprising the cover 52 is cured. The shafts are then separated about the plugs thereof.

In accordance with the invention, the presence of the longitudinal recessed edges 50 in the exterior shaft surface 28 defines longitudinal strips in the region of the recessed edges 50 wherein the thickness of the material comprising the cover 52 is greater than the thickness of the cover material overlying the flat outer surface of each of the exterior polygonal faces thereof. As a result, in the embodiment wherein the cover 52 comprises a layer of material which is applied to the shaft using the Stricktrusion™ process, the recessed edges 50 in combination with the material comprising the cover 52 together define a plurality of elongate longitudinally interiorly extending and protruding cushioning ribs 56 which fill and overly the recessed edges 50 defined in the exterior shaft surface 28 while advantageously preserving the outer octogonal geometry of the cover 52 and thus the handle.

In the embodiment where the cover 52 is a separate, pre-formed and pre-molded member, the cover 52 defines a plurality of elongate longitudinally extending ribs 56 protruding unitarily outwardly from the interior surface 55 thereof in the region of the corners 54. In this embodiment, cover 52 is applied, as by a shrink-wrap or the like process, to the shaft 26 and positioned thereon in a relationship wherein the ribs 56 thereon overly and fill the recessed edges 50.

By reason of the soft, pliable, deformable and impact-absorbing properties of the material comprising the cover 52, the interior ribs 56 define elongate longitudinal edges on the handle 24 which provide an increased tack and grip friction between the handle and a player's hands while also simultaneously providing cushioned corner or edge regions which reduce the risk of bodily and facial injury and damage to sticks which is normally associated with the use and swinging of lacrosse and hockey sticks during the normal course of play. The present invention as shown in FIGS. 2 and 3, wherein the cover 52 incorporates interior rather than exterior ribs, thus provides an attractive and suitable advantageous alternative to currently available handles where the ribs protrude outwardly from the exterior surface of the cover and adversely affect the outer polygonal and flat geometry of the handle.

Figure 4:
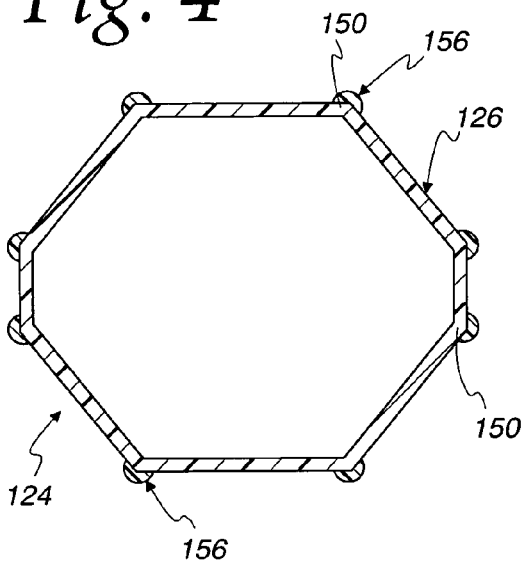
FIG. 4 is a vertical cross-sectional view of another embodiment of the handle of the present invention.
Figure 5:
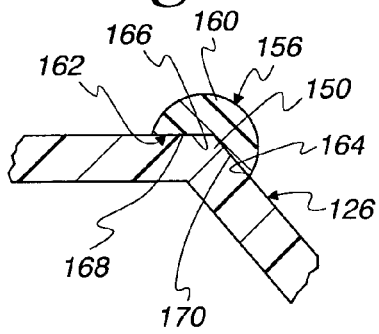
FIG. 5 is an enlarged, broken, vertical cross-sectional view of one of the corners of the handle of FIG. 4.

FIGS. 4 and 5 depict an alternate handle embodiment 124 including a shaft 126 similar in structure to the shaft 26 of handle 24 except that the edges or corners 150 thereof protrude outwardly from the exterior surface 128 rather than inwardly therein as with the recessed or grooved edges or corners 50 of shaft 26.

In the embodiment of FIG. 4, a plurality of elongate, longitudinally extending pre-formed exterior ribs 156 are applied directly over each of the corners or edges 150 of the shaft 126. Ribs 156 are preferably made of the same type of soft, pliable, deformable, impact-absorbing, and tacky material as the cover 52 and are adapted to provide an increased tack and grip friction between the handle 124 and a player's hand. Ribs 156 additionally are adapted to provide a protective cushion, barrier or cover for the edges or corners 150. An adhesive or the like is adapted to be applied either to the exterior surface of the edges 150 or the interior surface of the ribs 156 for securing the ribs 156 to the shaft 126.

As shown in FIG. 5, each of the ribs 156 includes a generally convex, dome-shaped outer surface 160 and an interior generally V-shaped concave surface 162 defining opposed interior faces 164 and 166 which are adapted to compliment, overly and abut against the opposed corner faces 168 and 170 defining each of the corners of edges 150 in the exterior shaft surface 128.

Figure 6:
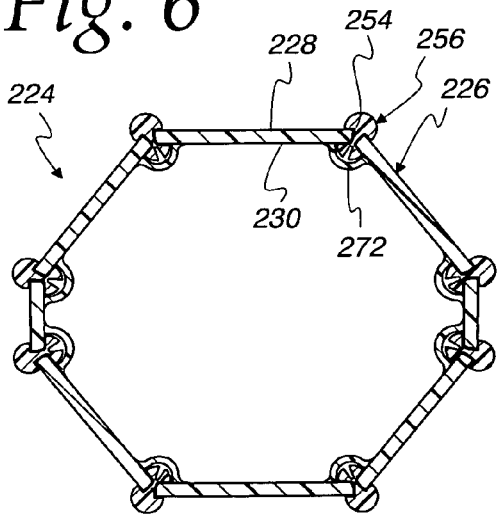
FIG. 6 is a vertical cross-sectional view of yet another embodiment of the handle of the present invention.
Figure 7:
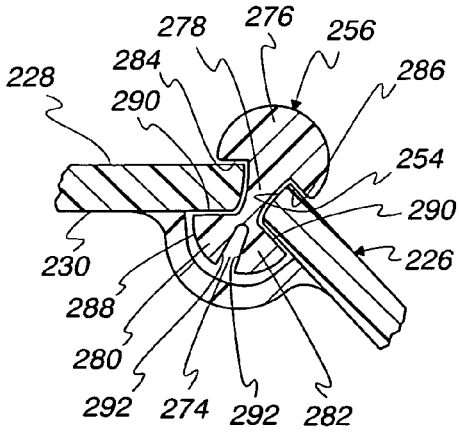
FIG. 7 is an enlarged, broken, vertical cross-sectional view of one of the corners of the handle of FIG. 6.

FIGS. 6 and 7 depict yet another handle embodiment 224 including a shaft 226 similar in structure to the shaft 26 of handle 24 except that, instead of recessed corners or edges 50 as in shaft 26, shaft 226 incorporates respective elongate and longitudinally extending corners or edges defining respective elongate longitudinal slits 254 extending between the respective exterior and interior surfaces 228 and 230 of the shaft 226. Arcuate barbs 272 unitary with the interior shaft surface 230 extend between each of the slits 254 respectively for reinforcing the shaft 226. Barbs 272 additionally define respective enclosed interior cavities 274 in communication with the slits 254 respectively.

Elongate longitudinal ribs 256 are adapted to be snap-fitted into the respective elongate longitudinal slits 254. Each of the ribs 256 includes a generally arcuate dome-shaped head 276, a body 278 depending unitarily downwardly from the bottom of the head 276, and a pair of generally bulbous legs 280 and 282 depending unitarily downwardly from the end of the body 278. The bottom surface of the head 276 additionally defines a pair of shoulders 284 and 286 and each of the legs define a generally convexly shaped end face 288 and opposed flat side faces 290 and 292.

In accordance with the present invention, ribs 256 are snap-fitted into the respective slits 254 as described below in more detail. Although not shown in any of the figures, it is understood that the elongate ribs 256 are initially aligned generally vertically co-planarly above the respective slits 254. Thereafter, the ribs 256 are lowered into contact with the exterior shaft surface 228 and the legs 280 and 282 of the respective ribs 256 are extended through the respective slits 254 and into the respective cavities 274 defined in the interior of the shaft 226.

It is understood of course that, as a result of contact between the arcuate end face 288 of the respective legs 280 and 282 and the exterior shaft surface 228 in the regions of the respective slits 254, the legs 280 and 282 initially are forced and squeezed inwardly against each other into a relationship wherein the side faces 292 of the respective legs are abutted against each other. The legs then spring back away from each other into the position of FIG. 7 after the legs 280 and 282 have cleared the shaft body to securely snap the ribs 256 to the shaft 226. In the snapped position of FIG. 7, the respective shoulders 284 and 286 on the head 276 of the respective ribs 256 are positioned in abutting relationship against the exterior shaft surface 228 and the flat side faces 290 of the respective legs are disposed against the interior surface 230 of shaft 226.

Figure 8:
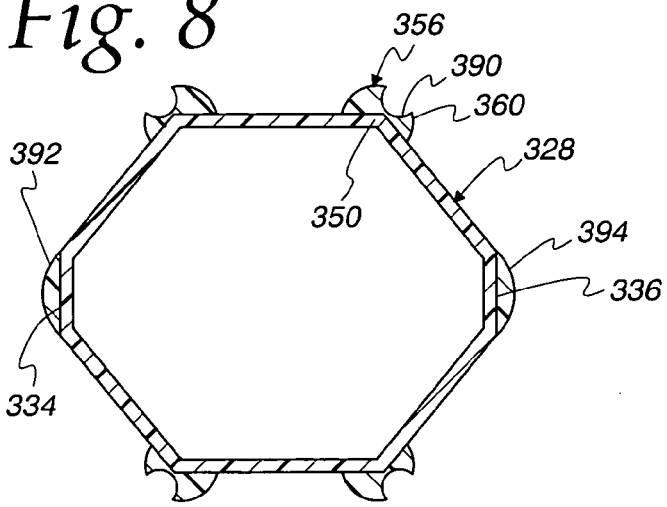
FIGS. 8–10 are vertical cross-sectional views of handles incorporating alternate rib configurations.
Figure 9:
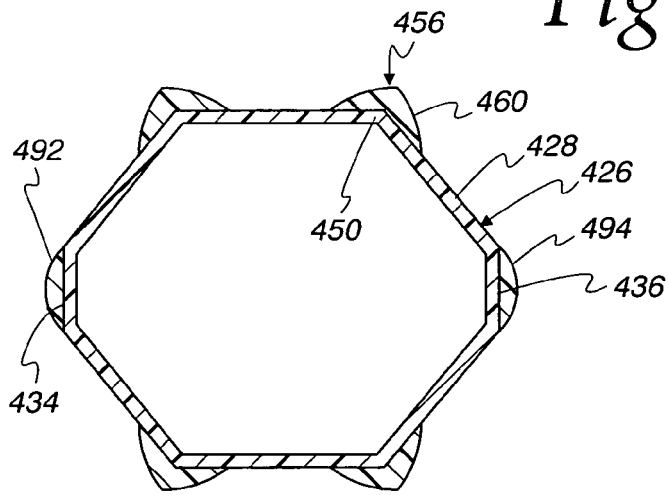
Figure 10:
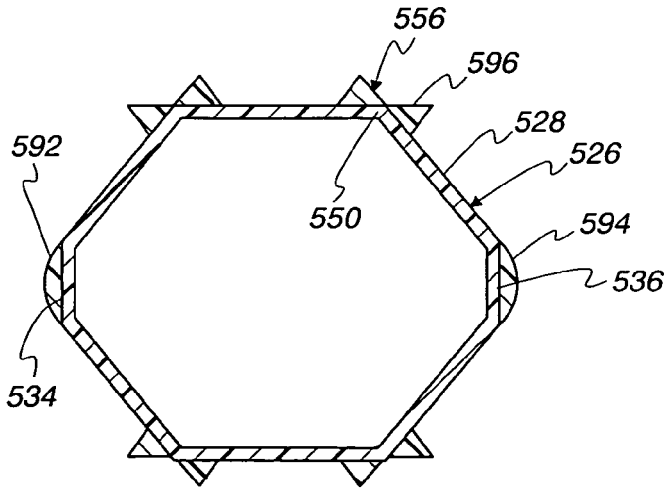

FIGS. 8-10 respectively depict alternate rib embodiments 356, 456 and 556.

Shaft 326 depicted in FIG. 8 is similar in structure to shaft 126. Ribs 356, secured over the respective longitudinal edges 350 defined in the exterior surface 328 of shaft 326, are similar in structure to the ribs 156 depicted in FIGS. 4 and 5 except that the exterior surface 360 of each of the ribs 356 includes an elongate, longitudinal dimple defining a generally concavely shaped elongate longitudinal groove 390. Shaft 326 additionally includes a pair of elongate longitudinal generally arcuately shaped pads 392 and 394 which cover substantially all of the exterior surface of each of the diametrically opposed exterior faces 334 and 336 of shaft 326.

Shaft 426 depicted in FIG. 9 is similar in structure to shaft 126. The ribs 456, secured over the longitudinal edges 450 on the exterior surface 428 of shaft 426, are also similar in structure to the ribs 156 depicted in FIGS. 4 and 5 except that the exterior surface 460 thereof is generally cone-shaped. Pads 492 and 494 are similar to the pads 392 and 394 shown in FIG. 8 and cover the exterior surface 528 of the shaft 526 in the region of the faces 534 and 536 thereof.

Shaft 526 depicted in FIG. 10 is similar in structure to shaft 126. Ribs 556, secured over the longitudinal edges 550 on the exterior surface 528 of shaft 526, are also similar in structure to the ribs 156 of FIGS. 4 and 5 except that the exterior surface 560 thereof includes a pair of inclined faces 594 and 595 defining a generally v-shaped groove 596 therein. Pads 592 and 594 are similar in structure to the pads 392 and 394 in FIG. 8.

In accordance with the present invention, the rib configurations of FIGS. 8–10 are adapted to provide different and/or customized tack and grip friction characteristics between the handle and a player's hand. It is understood, of course, that the rib configurations depicted in FIGS. 8–10 represent only three of the multitude of available configurations of the ribs of the present invention and that the invention encompasses any and all suitably configured ribs. It is further understood that, while the ribs of the embodiments shown in the FIGURES are preformed and adapted to be secured to the shafts by means of an adhesive, the present invention encompasses all other suitable processes and methods for securing the ribs to a shaft including, but not limited to, processes wherein the ribs are molded directly to the shaft surface.

Figure 11:
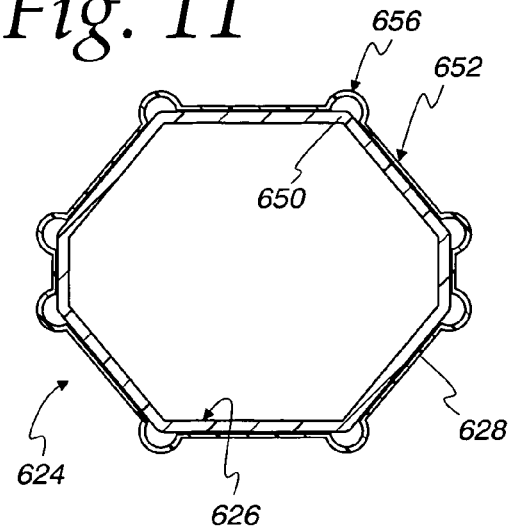
FIG. 11 is a vertical cross-sectional view depicting a further embodiment of the handle of the present invention.
Figure 12:
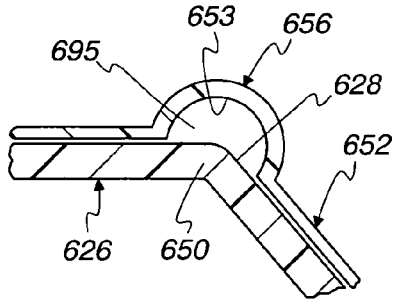
FIG. 12 is an enlarged, broken, vertical cross-sectional view of one of the corners of the handle of FIG. 11.

FIGS. 11 and 12 depict yet a further sports equipment handle embodiment 624 incorporating a shaft 626 similar in structure and composition to the shaft 126 of the handle 124 shown in of FIGS. 4 and 5. However, instead of incorporating individual ribs secured over each of the corners, handle 624 includes a unitary elongate longitudinal generally cylindrically shaped cover 652 comprising a single layer of material which, in the embodiment shown, is adapted to be slipped on and over the shaft 626 and subsequently secured to the exterior shaft surface 628 using a shrink-wrap, adhesive, or the like process. It is, of course, understood that the cover 652 is made of the same type of soft, pliable, deformable, impact-absorbing, tacky material as cover 52 and may be applied to the shaft 626 using any other known or suitable process or method such, as for example, insert or overmolding methods.

Cover 652 is characterized in that it incorporates a plurality of spaced-apart, generally elongate and longitudinally extending raised dome portions, bumps, or ribs 656 which protrude outwardly from the cover exterior and are adapted to overly the respective edges or corners 650 of the polygonally shaped shaft 626. In accordance with the present invention, the interior surface 653 of the cover 652, in the region of the ribs 656 formed thereon, is spaced from the exterior surface 628 of the respective corners or edges 650 of shaft 626 to define a plurality of respective air-filled cushion chambers or cavities 695 surrounding the respective corners or edges 650. Thus, the material comprising the ribs 656 provides for an increased tack and grip friction between the handle 624 and a player's hand while the air in each of the chambers 695 provides and defines an effective cushion which protects players from potential injury from contact with the edges of a stick.

Figure 13:
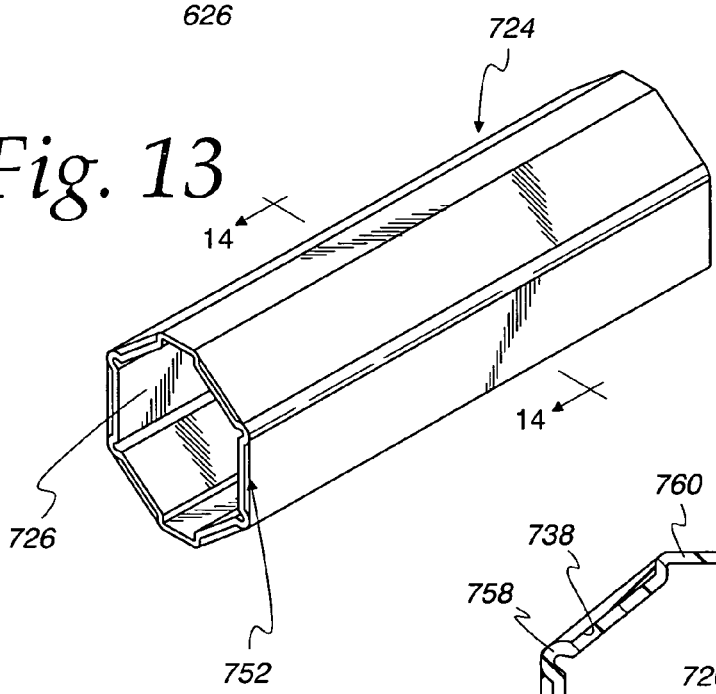
FIG. 13 is a broken perspective view of yet a further embodiment of the handle of the present invention.
Figure 14:
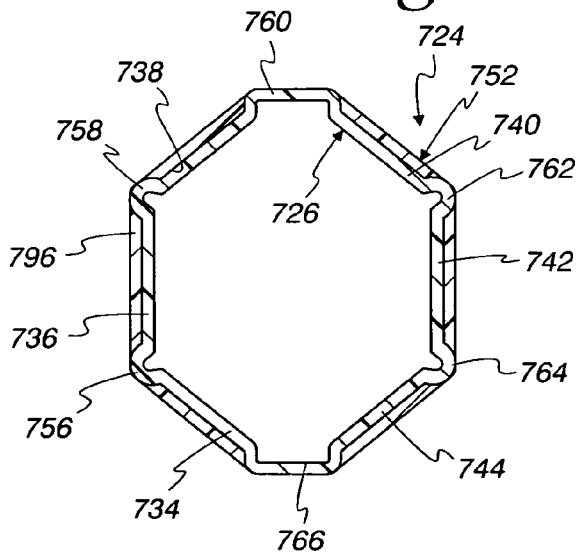
FIG. 14 is a vertical cross-sectional view taken along the plane 14—14 in FIG. 13.

FIGS. 13 and 14 depict still a further sports equipment handle embodiment 724 comprising a hollow generally polygonal shaft 726 comprised of a first material and a cover 752 made of a second material. Shaft 726 and cover 752 are preferably made of the same types of material as the shaft and ribs respectively of the earlier described handle embodiments.

Shaft 726 differs in structure from the earlier described shaft embodiments in that the shaft 726 comprises six exterior face panels 734, 736, 738, 740, 742 and 744 which are of equal width and are separated by a plurality of unitary outwardly projecting or raised elongate, longitudinal ribs 756, 758, 760, 762, 764 and 766 which extend around the peripheral exterior shaft surface 728 in spaced-apart and parallel relationship.

Four of the ribs 756, 758, 760 and 762 are generally oval in shape while the other two ribs 764 and 766 are generally wider than the other four ribs and are generally flat. Ribs 760 and 766 are disposed in a diametrically opposed relationship.

Thus, and as shown in FIGS. 13 and 14, the plurality of panels and ribs in combination define a plurality of spaced-apart elongate longitudinal recesses or depressions in the peripheral exterior shaft surface 728.

Cover 752 comprises a plurality of elongate longitudinal strips of material 796 which are positioned, applied and subsequently secured by adhesive or the like into the recesses defined by each of the respective exterior panels. As such, the cover 752 provides impaired cushioned and friction characteristics while simultaneously pressing the outer polygonal geometry of the handle 724. Alternatively, it is understood that the cover 752 may comprise a single layer of material applied to the exterior shaft 728 by any one of the several known methods and processes for securing a second material to the surface of a first material including, for example, the Sticktrusion™ method described earlier with respect to the handle 24 or any one of the other suitable or applicable processes identified above.

Figure 15:
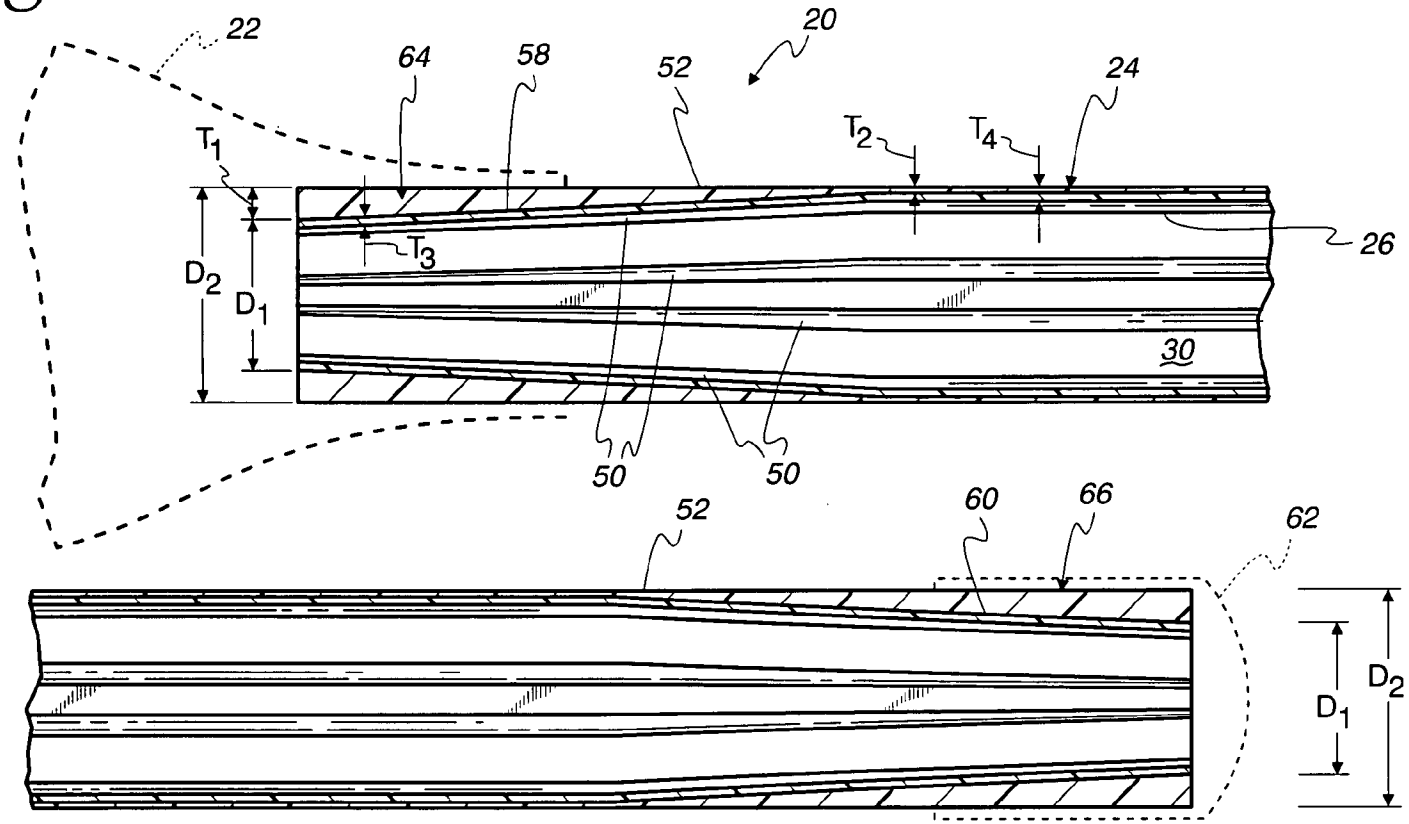
FIG. 15 is an enlarged, broken vertical cross-sectional view of the handle of the lacrosse stick of the present invention taken along the plane 15—-15 in FIG. 1.

FIG. 15 depicts yet a further feature of the handle 24 of the present invention. As shown therein, the shaft 26 of handle 24 is characterized in that it includes opposed tapered, frustoconically shaped end portions 58 and 60 each having a diameter designated $D_1$, which is less than the diameter $D_2$ of the remaining, non-tapered center portion of the shaft 26. Proximal end portion 58 is adapted to be fitted into the end of the head 22 and tapers inwardly into the end of the head 22. Distal end portion 60 tapers inwardly in the direction of the distal end of the shaft 26 which is covered by a plug 62 or the like.

The cover 52 surrounds the shaft 26 and may be applied thereto using the Sticktrusion™ process described earlier or any one of the other several methods and processes known in the art and described earlier for applying and securing a second layer of material to a first layer of material.

Thus, and as shown in FIG. 15, the handle 24 defines opposed end regions 64 and 66 in the area of the respective tapered shaft portions 58 and 60 wherein the material comprising the cover 52 has a thickness designated $T_1$, which is greater than the thickness, designated $T_2$, of the cover material overlying the non-tapered regions of the shaft 26 while still preserving the uniform and substantially constant outer diameter (designated $D_2$ in FIG. 15) and polygonal geometry of the handle 24 with the cover 52 thereon.

Moreover, and in those situations where the respective tapered end portions 58 and 60 are created by stretching of the material comprising the shaft 26, the respective tapered end portions 58 and 60 additionally define regions of the shaft 26 where the material comprising the shaft 26 has a thickness, designated $T_3$, which is less than the thickness, designated $T_4$, of the shaft material in the non-tapered regions of the shaft 26.

In accordance with the present invention, the respective tapered and thinned shaft end portions 58 and 60 create a handle for a lacrosse stick or the like with an improved "whip" or flexing curve in the region of the respective tapered portions for improved shot speed while still preserving the requisite outer polygonal, non-tapered shape and diameter $D_1$ of the exterior of the handle surface. In addition to providing improved "whip" characteristics, the respective tapered end portions 58 and 60 create regions on the handle 24 with increased or improved cushion and friction characteristics by virtue of an increased cover thickness in the region of the respective tapered end portions 58 and 60.

Although not shown in FIG. 15, it is understood that the invention is not restricted to the incorporation of tapered end portions but to any handle embodiment wherein the shaft 26 is recessed at any point along the length thereof so as to create a region(s) of reduced diameter or thickness. It is also understood that the material comprising the cover 52 can be tinted in the regions thereof overlying and surrounding the respective tapered end portions 58 and 60 thus allowing a player to visually discern and identify the handle regions with improved cushion, friction and/or whip characteristics.

It will be readily apparent from the foregoing detailed description of the invention and from the illustrations thereof that numerous variations and modifications may be effected without departing from the true spirit and scope of the novel concepts or principles of this invention.

We claim:

1. A sports equipment handle comprising:

an elongate shaft made of a first material and including at least one region having a depressed groove; and a cover made of a second material and surrounding the shaft in a manner whereby the outer surface of the handle including the cover is substantially continuous and the cover includes at least one region portion of increased thickness inwardly protruding so as to extend into the at least one region.

2. The sports equipment handle of claim 1 wherein the shaft includes a tapered end portion defining a region on the shaft of reduced diameter or thickness.

3. The sports equipment handle of claim 2 suitable for use on a lacrosse stick including a lacrosse head and the tapered end portion of the shaft extends into the head.

4. The sports equipment handle of claim 1 wherein the material comprising the shaft is extruded onto the shaft.

5. The sports equipment handle of claim 1 suitable for use on a lacrosse stick and wherein the shaft includes opposed tapered end portions defining the regions on the shaft of reduced diameter or thickness.

6. The sports equipment handle of claim 1 wherein the shaft includes a plurality of elongate longitudinal grooves formed thereon and extending around the circumference thereof in spaced-apart relationship, the respective grooves defining regions on the shaft of reduced diameter or thickness and the material comprising the ribs fills the grooves respectively and defines elongate longitudinally inwardly extending ribs.

7. The sports equipment handle of claim 6 suitable for use in connection with a lacrosse stick.

8. The sports equipment handle of claim 1 wherein the cover includes an interior surface and the shaft includes a plurality of longitudinal grooves thereon and extending around the circumference thereof in spaced-apart relationship, the respective grooves defining regions on the shaft of reduced thickness and the cover defining elongate longitudinal ribs extending outwardly from the interior surface and spaced around the circumference thereof and filling the respective grooves when the cover surrounds the shaft.

* * * * *

UNITED STATES PATENT AND TRADEMARK OFFICE

CERTIFICATE OF CORRECTION

PATENT NO. : 7,201,678 B2
APPLICATION NO. : 10/666449
DATED : April 10, 2007
INVENTOR(S) : Gary Filice et al.

It is certified that error appears in the above-identified patent and that said Letters Patent is hereby corrected as shown below:

Column 8, line 28, change “one region portion” to -- one portion --

Signed and Sealed this

Twenty-fourth Day of July, 2007

JON W. DUDAS
*Director of the United States Patent and Trademark Office*